US007175457B2

(12) United States Patent
Inoue

(10) Patent No.: US 7,175,457 B2
(45) Date of Patent: Feb. 13, 2007

(54) FAST TRANSMISSION-USE CONNECTOR

(75) Inventor: Shuichi Inoue, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/572,562

(22) PCT Filed: Sep. 28, 2004

(86) PCT No.: PCT/JP2004/014164

§ 371 (c)(1),
(2), (4) Date: Mar. 17, 2006

(87) PCT Pub. No.: WO2005/034292

PCT Pub. Date: Apr. 14, 2005

(65) Prior Publication Data

US 2006/0281344 A1 Dec. 14, 2006

(51) Int. Cl.
*H01R 13/15* (2006.01)

(52) U.S. Cl. ..... 439/260; 439/495

(58) Field of Classification Search ..... 439/260, 439/267, 495, 77, 67

See application file for complete search history.

(56) References Cited

U.S. PATENT DOCUMENTS

| | | | | |
|---|---|---|---|---|
| 4,509,098 | A * | 4/1985 | DasGupta et al. | 361/749 |
| 5,205,739 | A * | 4/1993 | Malo et al. | 439/66 |
| 6,027,347 | A * | 2/2000 | Reichle | 439/77 |

FOREIGN PATENT DOCUMENTS

| | | |
|---|---|---|
| JP | 60-89076 A | 5/1985 |
| JP | 61-190375 | 8/1986 |
| JP | 61-292809 | 12/1986 |
| JP | 63-55485 | 4/1988 |
| JP | 4-102588 | 9/1992 |
| JP | 05-062727 | 3/1993 |
| JP | 05-283865 A | 10/1993 |

(Continued)

OTHER PUBLICATIONS

International Search Report.

*Primary Examiner*—Phuong Dinh
(74) *Attorney, Agent, or Firm*—Rader, Fishman & Grauer PLLC

(57) ABSTRACT

A high-speed transmission connecting sheet 10 includes a first elastomer connector 1E formed on a top sheet 1, a second elastomer connector 2E formed on a bottom sheet 2, third elastomer connectors 3E formed on high-speed transmission boards 31 through 33, and fourth elastomer connectors 4E formed on intermediate layer boards 41 and 42. These elastomer connectors provide three-dimensional connection between the multiple high-speed transmission paths 3C formed on the high-speed transmission boards 31 through 33. A plug housing 5 has the high-speed transmission connecting sheet 10 installed therewithin, with the first elastomer connector 1E disposed at one inner wall of opposing inner walls, and the second elastomer connector 2E disposed at the other inner wall of the opposing inner walls. Receptacle pins 1P are disposed on the first elastomer connector 1E, and plug pins 2P are disposed under the second elastomer connector 2E. Both ends of the high-speed transmission connecting sheet 10 are pressed into contact, whereby the receptacle pins 1P and the plug pins 2P are connected through the multiple high-speed transmission paths 3C.

9 Claims, 9 Drawing Sheets

FOREIGN PATENT DOCUMENTS

| | | | |
|---|---|---|---|
| JP | 6-15283 | | 2/1994 |
| JP | 07-006823 | A | 1/1995 |
| JP | 09-199222 | | 7/1996 |
| JP | 11-121928 | | 4/1999 |
| JP | 2000-031614 | | 1/2000 |
| JP | 2000-68616 | | 3/2000 |
| JP | 2001-313109 | A | 11/2001 |
| JP | 2001-351703 | | 12/2001 |
| JP | 2002-280121 | A | 9/2002 |
| JP | 2003-068408 | A | 3/2003 |
| JP | 2003-092171 | A | 3/2003 |
| JP | 2003-100393 | A1 | 4/2003 |

* cited by examiner

FAST TRANSMISSION-USE CONNECTOR

TECHNICAL FIELD

The present invention relates to a high-speed transmission connector. More particularly, the present invention relates to a high-speed transmission connector which is used in various types of audio-visual equipment, home appliances, communication equipment, computers, peripheral equipment thereof, etc., and which includes connecting sheets in which high-speed transmission paths such as differential signal lines and the like are formed.

BACKGROUND ART

As the transmission speed of signals increases, there is a demand for the connectors which electrically connect electronic parts or electronic equipment to realize matching of characteristic impedance, which is an alternating electric current property, reduction in crosstalk, and also that effective noise countermeasures be implemented.

A connector having a connector receptacle and a connector plug, which are connected by fitting one to another, has been invented as a high-speed transmission connector to meet such demands (for example, Japanese Unexamined Patent Application, First Publication No. Hei 7-6823, referred to below as Patent Document 1). A transmission path block is stored within the housing of the connector plug of this connector, and a transmission path pattern for transmitting electric signals is formed in this transmission path block.

With the above connector, the transmission path block is in a plate shape, with the transmission path pattern being formed on one face of the transmission path block, for example, and a ground pattern being formed on the other face. Accordingly, this transmission path block can be used as a microstripline. A socket contact is also provided within the housing of the connector receptacle, for connection with the transmission path pattern by being fit to the transmission path block.

With the above connector, the ground pattern is disposed in a state removed from the transmission path pattern, so as to avoid influence of characteristic impedance, so electric signals can be transmitted at high speeds of several hundred to several thousand megabits per second. Furthermore, the connector also includes a filtering device in the transmission path pattern, so as to effectively implement noise countermeasures.

DISCLOSURE OF THE INVENTION

Problems to be Solved by the Invention

However, there is concern that with the above connector, that crosstalk may occur between transmission path patterns at high-frequency signal ranges where data transmission speeds of one gigabit per second or faster are required. Furthermore, filtering devices thus included leads to a complicated configuration of the transmission path block. This leads to a problem of increased manufacturing costs.

On the other hand, let us consider an arrangement in which the connecting transmission path patterns are connected one to another without connectors, and a sufficient distance is maintained between the transmission path patterns so that no crosstalk occurs therebetween. Examples of such arrangements include a multi-layer printed board having a structure in which multiple printed boards, each of which includes a transmission path pattern formed thereon, are layered, with the transmission path patterns formed on the printed boards being three-dimensionally connected.

With the aforementioned multi-layer printed board wherein the transmission path patterns are connected with each other three dimensionally, a transmission path pattern (signal pattern) formed on an upper layer printed board and a transmission path pattern (signal pattern) formed on a lower printed board, will be connected by via holes. However, there is a problem with such connection using the via holes or the like which vertically penetrate the multiple printed boards, for example, in that vertical signal reflection occurs. Furthermore, there is another problem that this via hole arrangement cannot provide equivalency in the vertical direction for stripline structure signals.

Such via holes are generally expensive to manufacture, and forming a great number of via holds raises the manufacturing costs of each multi-layer printed board. Accordingly, there is a demand for a new connection structure for connecting the transmission path patterns one to another, which can be applied to a multi-layer printed board having a multi-layer connection structure in which multiple transmission path patterns are three-dimensionally connected, instead of the conventional techniques employing via holes. In particular, a technique is needed to prevent deterioration in signals due to dielectric loss, reflection, etc., in high-speed transmission paths, in the region of high-frequency signals of which is required data transmission speeds of one gigabyte per second or faster.

The present invention has been made to solve the above-described problems, and accordingly, it is an object thereof to provide a high-speed transmission connector which includes a high-speed transmission connecting sheet employing a new multi-layer connecting structure instead of via-hole connecting structures, and which is used for connecting an external connecting terminal disposed on one side (e.g., receptacle pin) and an external connecting terminal disposed on the other side (e.g., plug pin) through the aforementioned high-speed transmission connecting sheet.

Means for Solving the Problems

The present inventor has invented the following high-speed transmission connector to achieve the above object.

In a first aspect of the present invention, a high-speed transmission connector for electrically connecting, through high-speed transmission paths, multiple first external connecting terminals disposed on one end and multiple second external connecting terminals disposed on another end, includes: a high-speed transmission connecting sheet in which a top sheet on which first elastomer connectors are formed on one end, a bottom sheet on which second elastomer connectors are formed on the other end, and a high-speed transmission path board for three-dimensionally connecting the first elastomer connectors and the second elastomer connects through multiple high-speed transmission paths having a strip-line structure, are layered; and an insulating plug housing in which the high-speed transmission connecting sheet is installed, with the first elastomer connectors being disposed on one inner wall of opposing inner walls and the second elastomer connectors being disposed on the other inner wall of the opposing inner walls, in which the multiple first external connecting terminals disposed on the one end are disposed on the first elastomer connectors, the multiple second external connecting terminals disposed on the other end are disposed under the second elastomer connectors, and both ends of the top sheet of the high-speed transmission connecting sheet are pressed into contact such that the first external connecting terminals and the second external connecting terminals are connected by the multiple high-speed transmission paths.

In a second aspect of the high-speed transmission connector according to the first aspect of the present invention, with the high-speed transmission connecting sheet installed therein, includes: a top sheet in which multiple first elastomer strips having electroconductivity between the front and rear sides are disposed on one end of a first elastomer sheet which is non-electroconductive, so as to form first elastomer connectors at the one end; a bottom sheet in which multiple second elastomer strips having electroconductivity between the front and rear sides are disposed on the other end of a second elastomer sheet which is non-electroconductive, so as to form second elastomer connectors at the other end; multiple high-speed transmission path boards in which multiple third elastomer strips having electroconductivity between the front and rear sides are disposed on both ends of a third elastomer sheet having a certain dielectric constant, so as to form third elastomer connectors at the both ends, and which has a strip-line structure in which multiple high-speed transmission paths are formed as patterns on the third elastomer sheet for connecting the multiple third elastomer strips formed on both ends of the third elastomer sheet; and one or more intermediate layer boards in which multiple fourth elastomer strips having electroconductivity between the front and rear sides are disposed on both ends of a fourth elastomer sheet which is non-electroconductive, so as to form fourth elastomer connectors at the both ends, in which the intermediate layer boards are interposed between the high-speed transmission path boards, the multiple high-speed transmission path boards and the one or more intermediate layer boards are layered such that the multiple high-speed transmission paths are three-dimensionally connected, and the top sheet and the bottom sheet are layered on the front and the back thereof.

In a third aspect of the high-speed transmission connector according to the second aspect of the present invention, with the high-speed transmission connecting sheet installed therein, in which the multiple parallel high-speed transmission paths formed on one of the high-speed transmission path boards disposed upper side and the multiple parallel high-speed transmission paths formed on another of the high-speed transmission path boards disposed lower side are arrayed alternately.

In a fourth aspect of the high-speed transmission connector according to any one of the first through third aspects of the present invention, in which the high-speed transmission paths include differential signal paths forming pairs.

In a fifth aspect of the high-speed transmission connector according to the first aspect of the present invention, further including: an insulating receptacle header which has a horizontal piece inserted from one end side of the plug housing, and which is disposed such that the multiple first external connecting terminals come into contact with the lower wall of the horizontal piece; and a paddle which is rotatably disposed at the top of one end of the plug housing and of which around the center of rotation is formed as a plate cam, and in a state of the horizontal piece of the receptacle header being inserted into the plug housing, upon turning the paddle, the plate cam presses down the horizontal piece so that the multiple first external connecting terminals are pressed into contact with the first elastomer connectors.

In a sixth aspect of the high-speed transmission connector according to the first aspect of the present invention, further including an insulating pressure-contact block assembled to the other end of the plug housing, in which the pressure-contact block presses the top sheet so as to press the second elastomer connectors into contact with the multiple second external connecting terminals.

In a seventh aspect of the high-speed transmission connector according to the fifth aspect of the present invention, in which a groove is formed on the upper face of the horizontal piece, and an L-shaped claw is formed on the edge portion of the paddle, thereby configuring a locking mechanism for retaining the claw at the groove in the horizontal piece upon turning the paddle to a laid down state.

The invention according to the first aspect of the present invention may be a high-speed transmission connector for electrically connecting multiple first external connecting terminals and multiple second external connecting terminals disposed opposing with high-speed transmission paths, the connector including: an insulating, generally rectangular parallelepiped-shaped plug housing; and a generally rectangular high-speed transmission connecting sheet held within the plug housing, in which the high-speed transmission connecting sheet has a layered structure of: a top sheet on which first elastomer connectors are formed, positioned at one end side of the high-speed transmission connecting sheet; a bottom sheet on which second elastomer connectors are formed, positioned at the other end side of the high-speed transmission connecting sheet; and high-speed transmission path boards which have multiple high-speed transmission paths having a stripline structure and which three-dimensionally connect the first elastomer connectors and the second elastomer connectors, the first elastomer connectors are disposed at one inner wall of a pair of opposing walls within the plug housing, the second elastomer connectors are disposed at the other inner wall of the pair of the opposing walls, the first external connecting terminals are disposed upon the first elastomer connectors, the second external connecting terminals are disposed under the second elastomer connectors, and both ends of the top sheet of the high-speed transmission connecting sheet are pressed into contact, thereby connecting the first external connecting terminals with the second external connecting terminals through the multiple high-speed transmission paths.

The invention of the second aspect may be a high-speed transmission connector according to the first aspect, with the high-speed transmission connecting sheet further including one or more intermediate layer boards placed between the high-speed transmission path boards, in which the top sheet and the bottom sheet are disposed so as to face one another sandwiching the layered article of the high-speed transmission path boards and intermediate layer boards therebetween, the top sheet includes a first elastomer sheet which is non-electroconductive, and multiple first elastomer strips with electroconductivity between the front and rear sides being disposed at the end of the top sheet where the first elastomer connectors are formed, the bottom sheet includes a second elastomer sheet which is non-electroconductive, and multiple second elastomer strips with electroconductivity between the front and rear sides being disposed at the end of the bottom sheet where the second elastomer connectors are formed, each of the high-speed transmission path boards includes a third elastomer sheet having a certain dielectric constant, and multiple third elastomer strips having electroconductivity between the front and rear sides being disposed on both ends of the third elastomer sheet, so as to form third elastomer connectors, the high-speed transmission paths are formed as patterns on the third elastomer sheet so as to connect between the multiple third elastomer strops formed on both ends opposing each other, and the intermediate layer boards includes a fourth elastomer sheet which is non-electroconductive, and multiple fourth elastomer strops having electroconductivity between the front and rear sides being disposed on both ends of the fourth elastomer sheet, so as to form fourth elastomer connectors at the both ends.

The term "elastomer sheet" as used here may be a sheet of a predetermined thickness with flexibility, having a predetermined front face and back face on the front and back of this thickness. Note that the term "having a predetermined thickness, with a predetermined front face and back face on the front and back of this thickness" may describe features of an ordinary sheet. The elastomer sheet may have a predetermined thickness, and a front and a back which are greater than the cross-section thereof, and which face one another across the thickness thereof. The term "flexibility" as used here may mean that the sheet can be elastically bent.

The term "elastomer strop" may mean a member which has flexibility in the thickness direction of the sheet, with a slender shape. Slender may mean that the ratio of length to width exceeds 1, and preferably may exceed 10.

The term "elastomer sheet which is non-electroconductive" may mean an elastomer sheet which is non-electroconductive, and non-electroconductive may mean that sufficiently low electroconductivity, or sufficiently high electric resistance. Also, an elastomer sheet which is non-electroconductive may mean overall that the sheet has non-electroconductivity such that sufficient non-electroconductivity can be provided in the non-conducting direction.

The term "elastomer sheet with non-electroconductivity" means a sheet formed of an ordinary non-electroconductive elastomer material. Specifically, examples of non-electroconductive elastomer materials include: natural rubber; polyisoprene rubber, butadiene copolymers and conjugated diene rubber and hydrogenates thereof; block copolymer rubber and hydrogenates thereof; chloroprene polymer; vinyl chloride vinyl acetate copolymer; urethane rubber; polyester rubber; epichlorohydrin rubber; ethylene propylene copolymer rubber; ethylene propylene diene copolymer rubber; soft liquid epoxy rubber; silicone rubber; fluoro rubber; etc. Examples of butadiene copolymer rubber and conjugated diene rubber include: butadiene-styrene; butadiene-acrylonitrile; butadiene-isobutylene; etc. Examples of block copolymer rubber include: styrene-butadiene-diene block copolymer rubber; styrene-isoprene block copolymer; etc.

Of these materials, silicone rubber is preferably employed from the perspective of the excellent heat resistance, low-temperature resistance, chemical resistance, weather resistance, electric insulation, and safety thereof. In general, such elastomer sheets having non-electroconductivity exhibit high volume electric resistance (1 MΩ·cm or more at 100 V, for example), and accordingly have no electroconductivity.

The term "electroconductive elastomer strips" may mean elastomer strips which are electroconductive, and may mean that electroconductivity is sufficiently high. Alternatively, this may mean that electric resistance is sufficiently low. Also, an elastomer strip means overall that the region having such a structure has electroconductivity such that sufficient electroconductivity can be provided in the conducting direction.

In general, the electroconductive elastomer may be formed by mixing an electroconductive material in the aforementioned non-electroconductive elastomer material so as to achieve a low specific volume resistance (e.g., 1 Ω·cm or less).

Of these elastomer materials, silicone rubber is preferably employed from the perspective of the excellent heat resistance, low-temperature resistance, chemical resistance, weather resistance, electric insulation, and safety thereof. An electroconductive material such as pure metals; alloys; or non-metal powders (or flakes, chips, foils, or the like) is mixed in such an elastomer material, thereby forming an electroconductive elastomer. Examples of pure metals include: gold; silver; copper; nickel; tungsten; platinum; and palladium. Examples of alloys include: stainless steel (SUS); phosphor bronze; beryllium copper; etc. Examples of non-metal electroconductive materials include carbon, etc. The carbon material may include carbon nanotubes, fullerenes, etc.

Elastomer strips having electroconductivity are arrayed on the edge of such an elastomer sheet having non-electroconductivity, thereby yielding an anisotropic electroconductive sheet wherein the edges of the elastomer sheet conduct in the thickness direction thereof, but the face direction thereof is non-electroconductive. Anisotropic electroconductive sheets can be used as elastomer connectors. With such an arrangement, the non-electroconductive elastomer sheet and the elastomer strips may be chemically bonded at the time of forming the elastomer connectors at the edges of the elastomer sheets. Also, a coupling agent may be applied to the interface therebetween for such chemical bonding. The coupling agent for this is a bonding agent for bonding these members, and may contain commercially-available adhesive agents. Specifically, silane, aluminum, titanate, or other similar coupling agents may be used, with silane coupling agents being desirably used.

The top sheet according to the present invention is obtained by the above-described method. That is to say, the top sheet is configured of the first elastomer sheet and the first elastomer strip. With such an arrangement, the multiple first elastomer strips having electroconductivity are arrayed at one edge portion of the first elastomer sheet with non-electroconductivity, thereby forming an anisotropic electro conductive sheet which serves as the first elastomer connectors. The top sheet formed with the first elastomer sheet having non-electroconductivity as a base has a structure in which the first elastomer sheet and the first elastomer strips are alternately arrayed at one end of the high-speed transmission connecting sheet, thus functioning as the first elastomer connector.

The first elastomer connector formed on one end of the top sheet functions as an edge connector for electrically connecting external connecting terminals on one side. Accordingly, the multiple first elastomer strips, which are to make contact with the external connecting terminals, may be arrayed at a pitch corresponding to that of the external connecting terminals disposed at one end.

The bottom sheet according to the present invention may also be formed in the same way as with the top sheet. That is to say, the bottom sheet is configured of the second elastomer sheet and the second elastomer strips. With such an arrangement, the multiple second elastomer strips having electroconductivity are arrayed at one edge portion of the second elastomer sheet with non-electroconductivity, thereby forming an anisotropic electroconductive sheet which serves as the second elastomer connectors. The bottom sheet formed with the second elastomer sheet having non-electroconductivity as a base has a structure in which the second elastomer sheet and the second rectangular elastomer regions are alternately arrayed at the other end of the high-speed transmission connecting sheet, thus functioning as the second elastomer connector.

The second elastomer connector formed on one end of the bottom sheet functions as an edge connector for electrically connecting external connecting terminals on the other side. Accordingly, the multiple second elastomer strips, which are to make contact with the external connecting terminals, may be arrayed at a pitch corresponding to that of the external connecting terminals disposed at the other end.

The "third elastomer sheet having a certain dielectric constant" is a dielectric material for forming the stripline structures, and may be formed by including a substance with a certain relative dielectric constant, and for example, may have a dielectric constant equivalent to that of a Teflon (Registered Trademark) board employed in a rigid printed board.

The high-speed transmission path boards are configured by arraying multiple third elastomer strips at both edges of the third elastomer sheet having certain dielectric constant, for example. The third elastomer strips are preferably arrayed so as to correspond to the pitch of the external connecting terminals, and have electroconductivity between the front and back sides of the high-speed transmission path boards. Also, the multiple third elastomer strips may be disposed so as to correspond to the pitch of the high-speed transmission paths. Thus, at both edges of the third elastomer sheet, the third elastomer sheet and the third elastomer strips are alternately arrayed to form an anisotropic sheet, thereby forming the third elastomer connector.

As a method for manufacturing the third elastomer connector having a structure in which the regions of the third elastomer sheet and the third elastomer strips are alternately arrayed, these elastomer regions may be chemically bonded. A coupling agent may be introduced therebetween for such chemical bonding. Such a coupling agent is a bonding agent for bonding these members, and may contain commercially available adhesive agents. Specifically, silane, aluminum, titanate, or other like coupling agents may be used, with silane coupling agents being used well.

The high-speed transmission boards may be formed by depositing copper foil on one face of the third elastomer sheet, and then patterning the high-speed transmission paths by print etching. Such a high-speed transmission path board has a strip line structure in which copper foil serving as a ground layer is deposited facing the high-speed transmission paths.

The high-speed transmission board has multiple third elastomer strips serving as edge connectors on either edge. Furthermore, an arrangement may be made in which between the multiple third elastomer strips is connected by patterns of differential signal paths forming pairs, for example. Furthermore, the overall high-speed transmission path board may have flexibility in the sheet thickness direction.

Each of the intermediate layer boards has a structure in which the fourth elastomer strips having electroconductivity are arrayed on both edge portions of the fourth elastomer sheet having non-electroconductivity, thereby forming an anisotropic electroconductive sheet serving as the fourth elastomer connectors. Each of the intermediate layer boards formed primarily of the fourth elastomer sheet having non-electroconductivity provides the fourth elastomer connectors on both ends thereof having a structure in which the regions of the fourth elastomer sheet and the fourth elastomer strips are alternately arrayed.

These fourth elastomer connectors formed on both ends of the intermediate layer board function as edge connectors electrically connected to the third elastomer connectors of the high-speed transmission path boards layered above and below with the intermediate layer board therebetween. The multiple fourth elastomer strips may be arrayed for the fourth elastomer connector at a pitch matching that of the multiple third elastomer strips.

The high-speed transmission connecting sheet has a structure in which the high-speed transmission path boards are layered with the intermediate layer board sandwiched therebetween. With such an arrangement, the multiple high-speed transmission path boards and the one or more intermediate layer boards are layered such that the multiple high-speed transmission paths are three-dimensionally connected. Furthermore, the top sheet and the bottom sheet are layered on the aforementioned layered structure. The face where the top sheet is exposed is the front face of the high-speed transmission connecting sheet, and the face where the bottom sheet is exposed is the rear face of the high-speed transmission connecting sheet.

This high-speed transmission connecting sheet is disposed within the insulating plug housing. Within the plug housing, the first elastomer connector is disposed at one inner wall of the opposing inner walls, and the second elastomer connector is disposed at the other inner wall of the opposing inner walls.

With the high-speed transmission connector according to the present invention, the multiple first external connecting terminals disposed on one side of the plug housing are disposed upon the first elastomer connectors. On the other hand, the second multiple external connecting terminals disposed on the other side are disposed below the second elastomer connectors. With such an arrangement, both ends of the top sheet of the high-speed transmission connecting sheet are pressed into contact, thereby connecting the first external connecting terminals and the second external connecting terminals through the multiple high-speed transmission paths.

With the high-speed transmission connector having such a high-speed transmission connecting sheet therewithin, the multiple elastomer strips provided on the edges of the high-speed transmission sheets function as edge connectors. With such an arrangement, the elastomer strips come into tight contact with the external connecting terminals, so there is no longer an air layer between the external connecting terminals and the edge connectors. This provides the advantage that reflection of high-speed signals at the connection ends of the external connecting terminals does not readily occur.

The high-speed transmission connecting sheet employed in the high-speed transmission connector according to the present invention has multiple layered high-speed transmission path boards. In a preferred embodiment, the mutually parallel high-speed transmission paths formed on the high-speed transmission path board situated at the upper side and mutually parallel high-speed transmission paths formed on the high-speed transmission path board situated at the lower side are alternately arrayed so as to not overlap.

With such a high-speed transmission connecting sheet, sufficient space can be provided between high-speed transmission paths, so as to reduce crosstalk therebetween. With a preferred embodiment, the high-speed transmission paths may include pairs of differential signal paths. More preferably, an arrangement in which a ground pattern is formed between the mutually parallel high-speed transmission paths provides the advantage of further reduced crosstalk between the high-speed transmission paths.

A preferred embodiment of the high-speed transmission connector according to this invention includes an insulating receptacle header having a horizontal piece inserted from one end side of a generally rectangular parallelepiped box-shaped plug housing and disposed such that the multiple first external connecting terminals come into contact with the lower wall of the horizontal piece, and a paddle rotatably disposed at the top of one end of the plug housing. With such an arrangement, the portion around the center of rotation of the paddle is formed as a plate cam. In a state of the horizontal piece of the receptacle header being inserted into the plug housing, upon turning the paddle, the aforementioned plate cam presses down the horizontal piece, thereby pressing the multiple first external connecting terminals into contact with the first elastomer connectors.

Also, a preferred embodiment of the high-speed transmission connector according to this invention comprises an insulating pressure-contact block assembled to the other end of the plug housing. With such an arrangement, the pressure-contact block presses the top sheet so as to press the second elastomer connectors into contact with the multiple second external connecting terminals.

Also, a preferred embodiment of the high-speed transmission connector according to this invention has a groove formed on the upper face of the horizontal piece, with an L-shaped claw formed on the edge portion of the paddle. Such a structure provides a locking mechanism for retaining the claw at the groove in the horizontal piece upon turning the paddle to a laid down state.

Advantages

The high-speed transmission connector according to the present invention has multiple elastomer strips having electroconductivity serving as edge connectors formed on the high-speed transmission connecting sheet disposed within the housing. With such an arrangement, the external connecting terminals are in close planar contact with the elastomer strips, so there is no longer an air layer between the external connecting terminals and the edge connectors. This provides the advantage that reflection of high-speed signals at the connection ends of the external connecting terminals does not readily occur.

Also, with the high-speed transmission connector according to the present invention, the elastomer strips of the high-speed transmission connecting sheet provided within the housing connect between the layers of multiple paths instead of via holes. Furthermore, the high-speed transmission paths do not overlap with each other between the layers but are alternately arrayed. This enables crosstalk to be reduced between the high-speed transmission paths while increasing the density at which the overall high-speed transmission paths are installed.

Furthermore, with the high-speed transmission connector according to the present invention, the external connecting terminals can be easily connected and detached to and from the high-speed transmission connecting sheet at one end. Furthermore, the aforementioned high-speed transmission connector has a clocking mechanism, which ensures connection between the external connecting terminals and the high-speed transmission connecting sheet.

Figure 1:
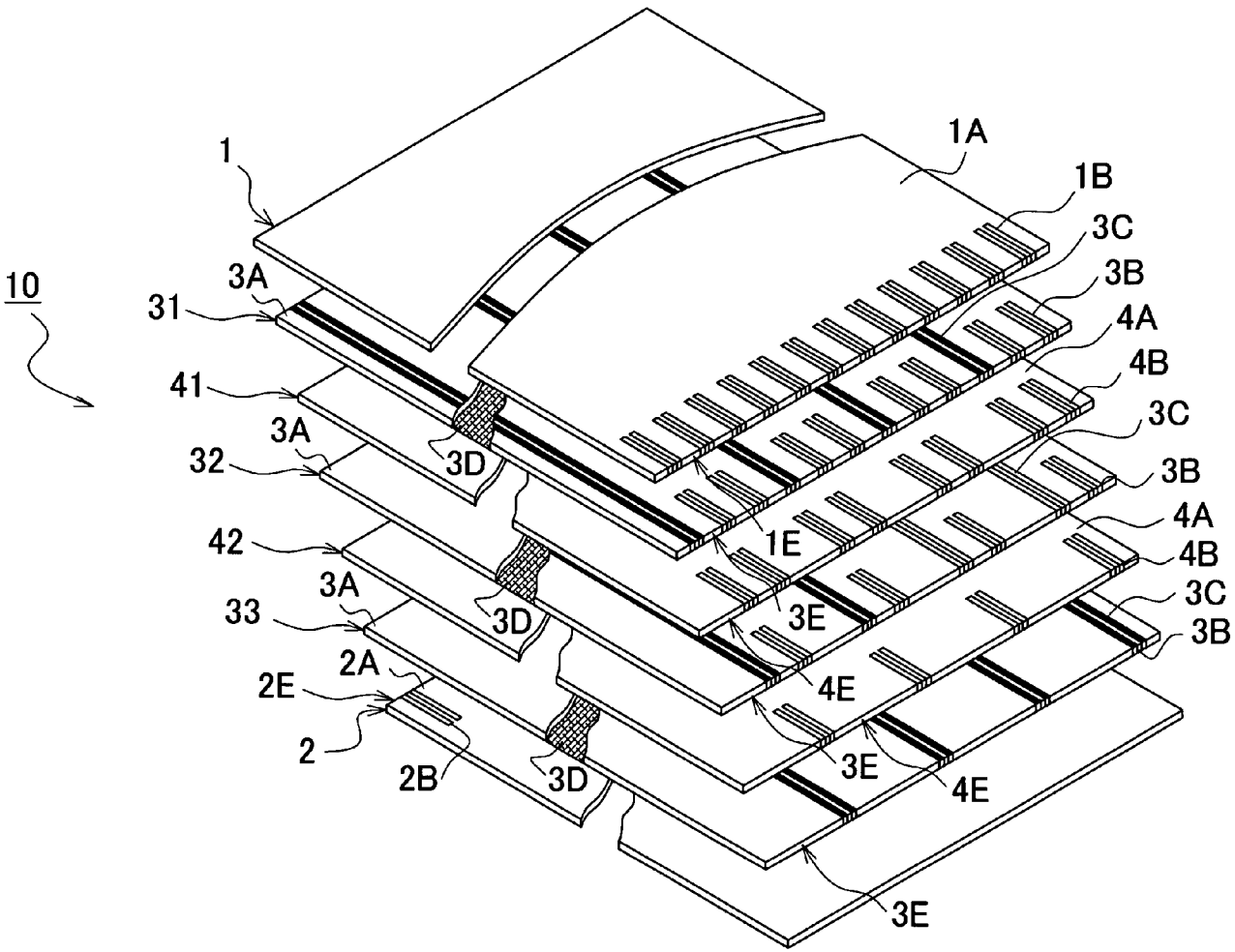
FIG. 1 is a disassembled perspective view illustrating the configuration of a high-speed transmission connecting sheet installed within a high-speed transmission connector according to an embodiment of the present invention.

| Reference Numerals | |
|---|---|
| 1 | top sheet |
| 1A | first elastomer sheet |
| 1B | first elastomer strips |
| 1E | first elastomer connector |
| 1P | receptacle pins |
| 2 | bottom sheet |
| 2A | second elastomer sheet |
| 2B | second elastomer strips |
| 2E | second elastomer connector |
| 2P | plug pins |
| 3A | third elastomer sheet |
| 3B | third elastomer strips |
| 3C | high-speed transmission paths |
| 3D | ground layer |
| 3E | third elastomer connector |
| 4A | fourth elastomer sheet |
| 4B | fourth elastomer strips |
| 4E | fourth elastomer connector |
| 5 | plug housing |
| 6 | receptacle header |

PREFERRED MODE FOR CARRYING OUT THE INVENTION

The best mode for carrying out the present invention will be described with reference to the drawings.

Figure 4:
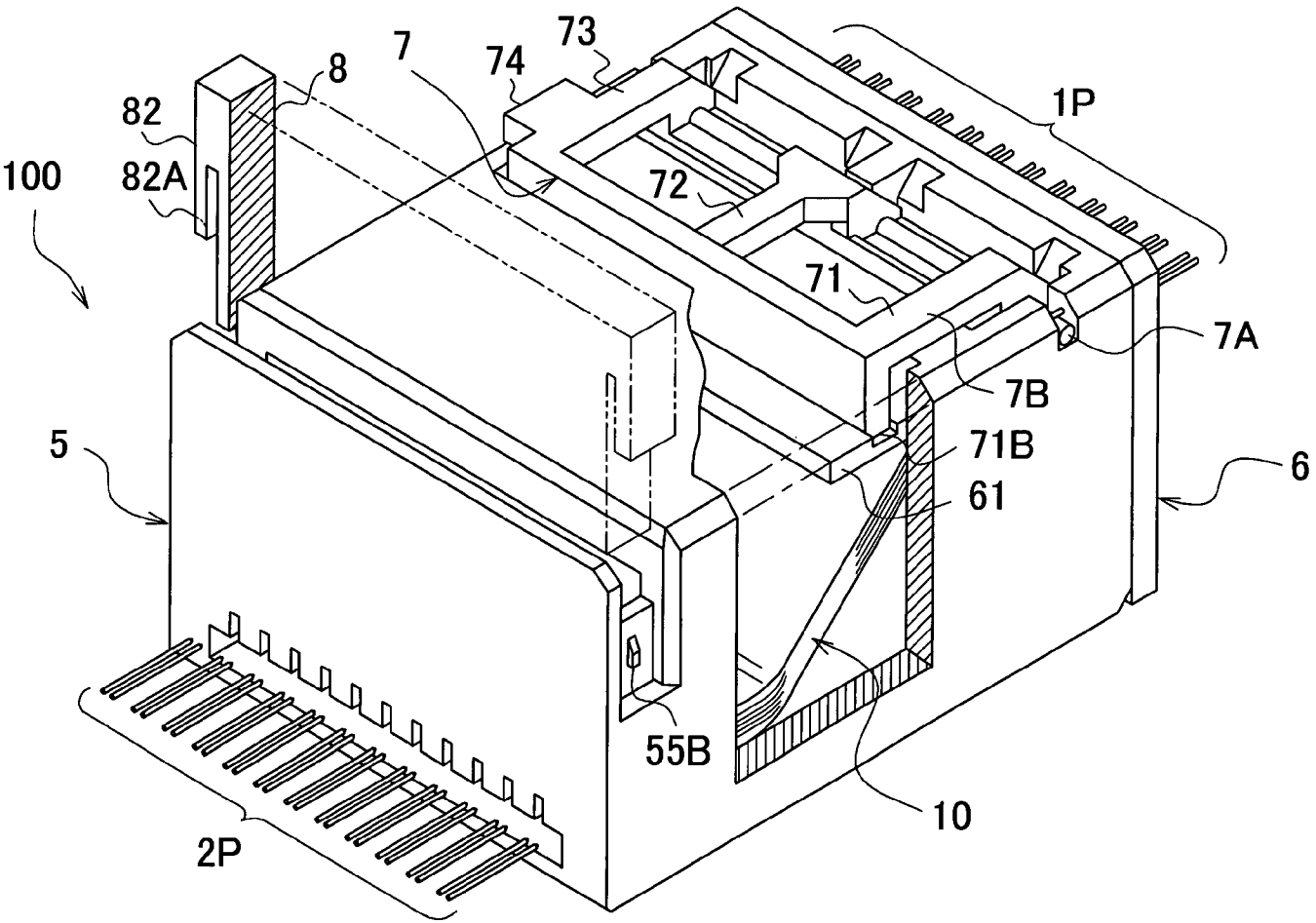
FIG. 4 is an external perspective view of the high-speed transmission connector according to the present invention, as viewed from the other end.

FIG. 4 is an external perspective view of a high-speed transmission connector (hereafter referred to simply as "connector") 100 according to an embodiment of the present invention, with the connector 100 comprising a generally rectangular parallelepiped box-shaped plug housing 5 and a high-speed transmission connecting sheet 10 held within the plug housing 5. FIG. 1 is a disassembled perspective view illustrating the configuration of the high-speed transmission connecting sheet 10 disposed within the connector 100 serving as the embodiment of the present invention. In FIG. 1, reference numeral 1 denotes a top sheet, and reference numeral 2 denotes a bottom sheet. Reference numerals 31, 32 and 33 denote high-speed transmission path boards. Reference numerals 41 and 42 denote intermediate layer boards.

With the embodiment shown in FIG. 1, the top sheet 1 comprises a first elastomer sheet 1A formed of non-electroconductive elastomer and first elastomer strips 1B formed of electroconductive elastomer, formed into a sheet. The top sheet 1 uses the first elastomer sheet 1A as a base, with multiple first elastomer strips 1B formed on one end of the first elastomer sheet 1A. The first elastomer strips 1B have electroconductivity between the front and the back faces of the top sheet 1. The first elastomer strips 1B are configured of electroconductive particles mixed into a non-electroconductive elastomer material having relatively high flexibility. The portion at one end of the top sheet 1 where the first elastomer sheet 1A and the first elastomer strips 1B are alternately arrayed is electroconductive in the thickens direction of the top sheet 1, thereby making up an anisotropic electroconductive sheet which is not electroconductive in the face direction, which configures a first elastomer connector 1E.

Figure 2:
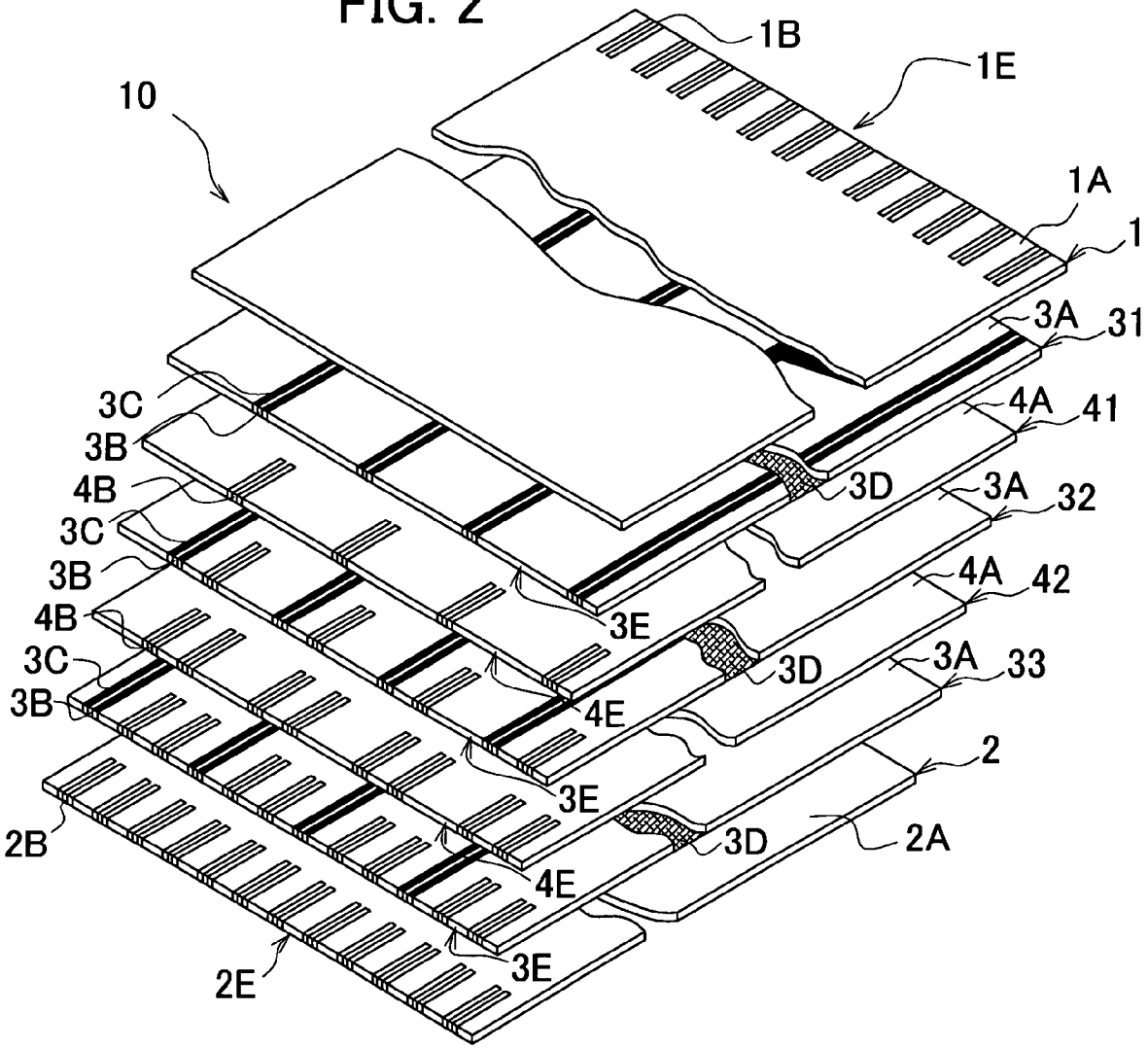
FIG. 2 is a disassembled perspective view of the high-speed transmission connecting sheet according to the present invention, as viewed from the other end.

FIG. 2 is a disassembled perspective view of the high-speed transmission connecting sheet 10 shown in FIG. 1, as viewed from the opposite end.

In FIG. 2, the bottom sheet 2 includes a second elastomer sheet 2A formed of non-electroconductive elastomer and second elastomer strips 2B formed of electroconductive elastomer, formed into a sheet. The bottom sheet 2 uses the second elastomer sheet 2A as a base, with multiple second elastomer strips 2B formed on one end of the second elastomer sheet 2A. The second elastomer strips 2B have electroconductivity between the front and the back faces of the bottom sheet 2. The second elastomer strips 2B are configured of electroconductive particles mixed into a non-electroconductive elastomer material having relatively high flexibility. The portion at one end of the top sheet bottom 2 where the second elastomer sheet 2A and the second elastomer strips 2B are alternately arrayed makes up an anisotropic electroconductive sheet, which configures a second elastomer connector 2E.

The high-speed transmission path boards 31 through 33 each include a third elastomer sheet 3A formed of elastomer having a predetermined dielectric constant and third elastomer strips 3B formed of electroconductive elastomer, formed into a sheet. The high-speed transmission path boards 31 through 33 use the third elastomer sheet 3A as a base, with multiple third elastomer strips 3B formed on both ends of the third elastomer sheet 3A so as to face one another. The third elastomer strips 3B are electroconductive between the front and back faces of the high-speed transmission path boards 31 through 33. The third elastomer strips 3B are configured of electroconductive particles mixed into silicone rubber. Both ends of the high-speed transmission path boards 31 through 33 have the third elastomer sheet 3A and the third elastomer strips 3B alternately arrayed, making up an anisotropic electroconductive sheet, which configures a third elastomer connector 1E.

The high-speed transmission path boards 31 through 33 are formed with multiple high-speed transmission paths 3C formed on the surface of the third elastomer sheets 3A. Each of the multiple high-speed transmission paths 3C connects multiple third elastomer strips 3B facing one another. The multiple high-speed transmission paths 3C are arranged such that a pair of high-speed transmission paths 3C serve as a differential signal path, with the differential signal paths formed of the pairs of high-speed transmission paths 3C being disposed at equal intervals with regard to each of the high-speed transmission path boards 31 through 33. Also, each high-speed transmission path board 31 through 33 has a ground layer 3D layered on the rear portion of the third elastomer sheet 3A thereof. Accordingly, the high-speed transmission path boards 31 through 33 have strip line structures.

The intermediate layer boards 41 and 42 each include a fourth elastomer sheet 4A formed of non-electroconductive elastomer and fourth elastomer strips 4B formed of electroconductive elastomer, formed into a sheet. The intermediate layer boards 41 and 42 use the fourth elastomer sheet 4A as a base, with multiple fourth elastomer strips 4B formed on both ends of the fourth elastomer sheet 4A so as to face one another. The fourth elastomer strips 4B have electroconductivity between the front and the back faces of the intermediate layer boards 41 and 42. The fourth elastomer strips 4B are configured of electroconductive particles mixed into silicone rubber. Both ends of the intermediate layer boards 41 and 42 have the fourth elastomer sheet 4A and the fourth elastomer strips 4B alternately arrayed, making up an anisotropic electroconductive sheet, which configures a fourth elastomer connector 4E.

Figure 3:
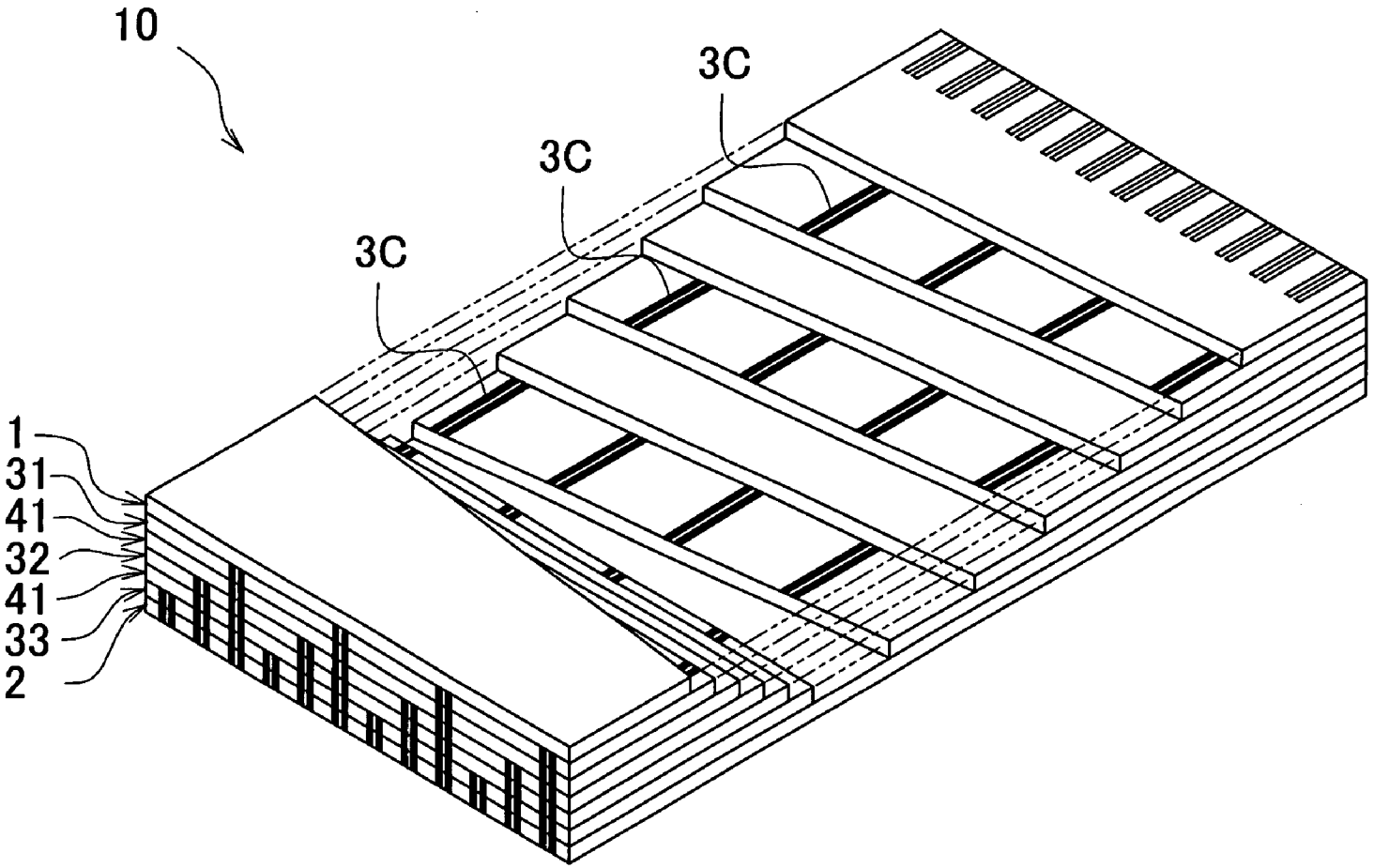
FIG. 3 is an external perspective view of the high-speed transmission connecting sheet installed within the high-speed transmission connector according to the present invention.

The members configured thus are layered and adhered in the order of the bottom sheet 2, high-speed transmission path board 33, intermediate board 42, high-speed transmission path board 32, intermediate board 41, high-speed transmission path board 31, and top sheet 1, thereby yielding the layered article shown in FIG. 3, which is the high-speed transmission connecting sheet 10. That top sheet 1 and bottom sheet 2 are layered such that the end portions where the anisotropic electroconductive sheets have been formed are facing away from each other.

FIG. 3 is a perspective external view of the high-speed transmission connecting sheet 10 disposed within the connector 100 according to the present invention. In the embodiment shown in FIG. 3, the high-speed transmission paths 3C serving as 12 pairs of differential signal paths are distributed, four each, to the three high-speed transmission path boards 31 through 33, and are connected three-dimensionally via the third elastomer strips 3B and the fourth elastomer strips 4B. The high-speed transmission connecting sheet 10 is arranged such that the multiple high-speed transmission paths formed parallel to each other at the high-speed transmission path board toward the top in the drawing, and the multiple high-speed transmission paths formed parallel to each other at the high-speed transmission path board toward the bottom in the drawing, are arrayed alternately.

Pressing both end portions of the high-speed transmission connecting sheet 10 formed thus effects contact between the first elastomer connector 1E of the top sheet 1 and the high-speed transmission paths 3C on the high-speed transmission path board 31 as shown in FIG. 1, so as to conduct. Furthermore, as shown in FIG. 2, the high-speed transmission paths 3C on the high-speed transmission path board 31 come into contact with the third elastomer connector 3E on the high-speed transmission path board 31, the fourth elastomer connector 4E on the intermediate layer board 41, the third elastomer connector 3E on the high-speed transmission path board 32, the fourth elastomer connector 4E on the intermediate layer board 42, the third elastomer connector 3E on the high-speed transmission path board 33, and the second elastomer connector 2E on the bottom sheet 2, so as to conduct with each other.

Next, the configuration of the connector 100 according to the present invention will be described with reference to FIG. 4 and FIG. 5. FIG. 4 is an external perspective view of the connector 100 as viewed from one end side, and FIG. 5 is an external perspective view of the connector 100 as viewed from the other end side, with cross-sections of the principal components being shown in FIG. 5.

As shown in FIG. 4, the high-speed transmission connecting sheet 10 is installed within the insulating plug housing 5. As shown by the embodiment illustrated in FIG. 5, the high-speed transmission connecting sheet 10 is disposed such that the end of the first elastomer connector 1E is in contact with one inner wall 51 of a pair of opposing inner walls 51 and 52, and the end of the second elastomer connector 2E is in contact with the other inner wall 52 of the opposing inner walls 51 and 52. Note that a loading ledge 63 is connected to the inner wall 51 so as to protrude out toward the inner wall 52.

Also, as shown in FIG. 4, multiple receptacle pins 1P, serving as first external connecting terminals, are disposed on one of a pair of opposing walls of the plug housing 5. Also, multiple plug pins 2P, serving as second external connecting terminals, are disposed on the other wall of the plug housing 5. As shown in FIG. 5, the receptacle pins 1P are held by an insulating receptacle header 6, and are disposed on one face (upper) of the high-speed transmission connecting sheet 10 so as to be in contact with the first elastomer connector 1E. On the other hand, the plug pins 2P are inserted into the plug housing 5, and are disposed on the other face (lower) of the high-speed transmission connecting sheet 10 so as to be in contact with the second elastomer connector 2E.

Figure 5:
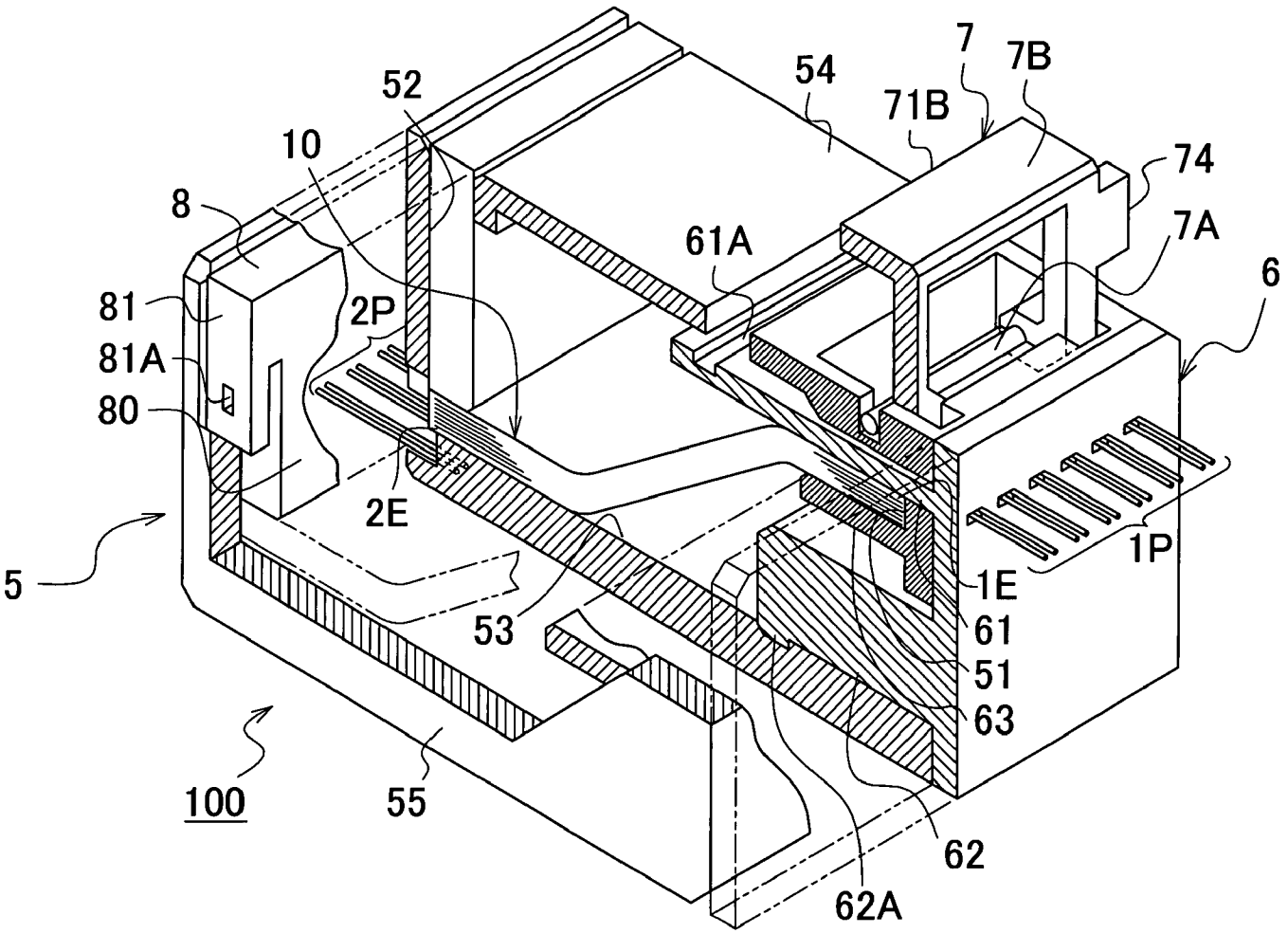
FIG. 5 is an external perspective view of the high-speed transmission connector according to the present invention, as viewed from the one end.

As shown in FIG. 5, the receptacle header 6 has a horizontal piece 61 to be inserted from one end side face of the plug housing 5, and the receptacle pins 1P are positioned so as to be in contact with the one side (lower side) wall of the horizontal piece 61. Note that the receptacle header 6 has a fitting block 62 which extends toward the inner wall 52 side, below the horizontal piece 61, i.e., facing the horizontal piece 62 across from the receptacle pins 1P.

Also, as can be seen from FIG. 4 and FIG. 5, a paddle 7 is rotatably disposed at the top of one end of the plug housing 5, and around the center of rotation of the paddle 7 is formed as a plate cam, as described later. Note that FIG. 4 shows the state in which the paddle 7 is laid down and closed, and FIG. 5 shows the state in which the paddle 7 is raised and opened.

As shown in FIG. 4, the paddle 7 is integrally formed of a metal rotational shaft 7A and an insulating lever portion 7B. The lever portion 7B has arms 71 through 73 extending from the rotational shaft 7A, with the rotation shaft 7A being pressed into the end portion of these arms 71 through 73, for example. A tab 74 protrudes from the side of the arm 73 to facilitate opening and closing operations of the lever portion 7B. Note that an L-shaped claw 71B is formed on the extremity of the lever portion 7B. This claw 71B is retained to a groove 61A formed in the horizontal piece 61, as described later.

As shown in FIG. 4, the plug housing 5 has an insulating pressure-contact block 8. The pressure-contact block 8 has a flange 81 (see FIG. 5) and a flange 82 on either side thereof. The center portion of the pressure-contact block 8 is formed as a protruding piece 80 for pressing the high-speed transmission connecting sheet 10 (see FIG. 5).

As shown in FIG. 5, an indent 81A is formed in the flange 81 in the form of a rectangular through hole. Also, as shown in FIG. 4, an indent 82A is formed in the flange 82 in the form of a rectangular through hole.

Figure 6:
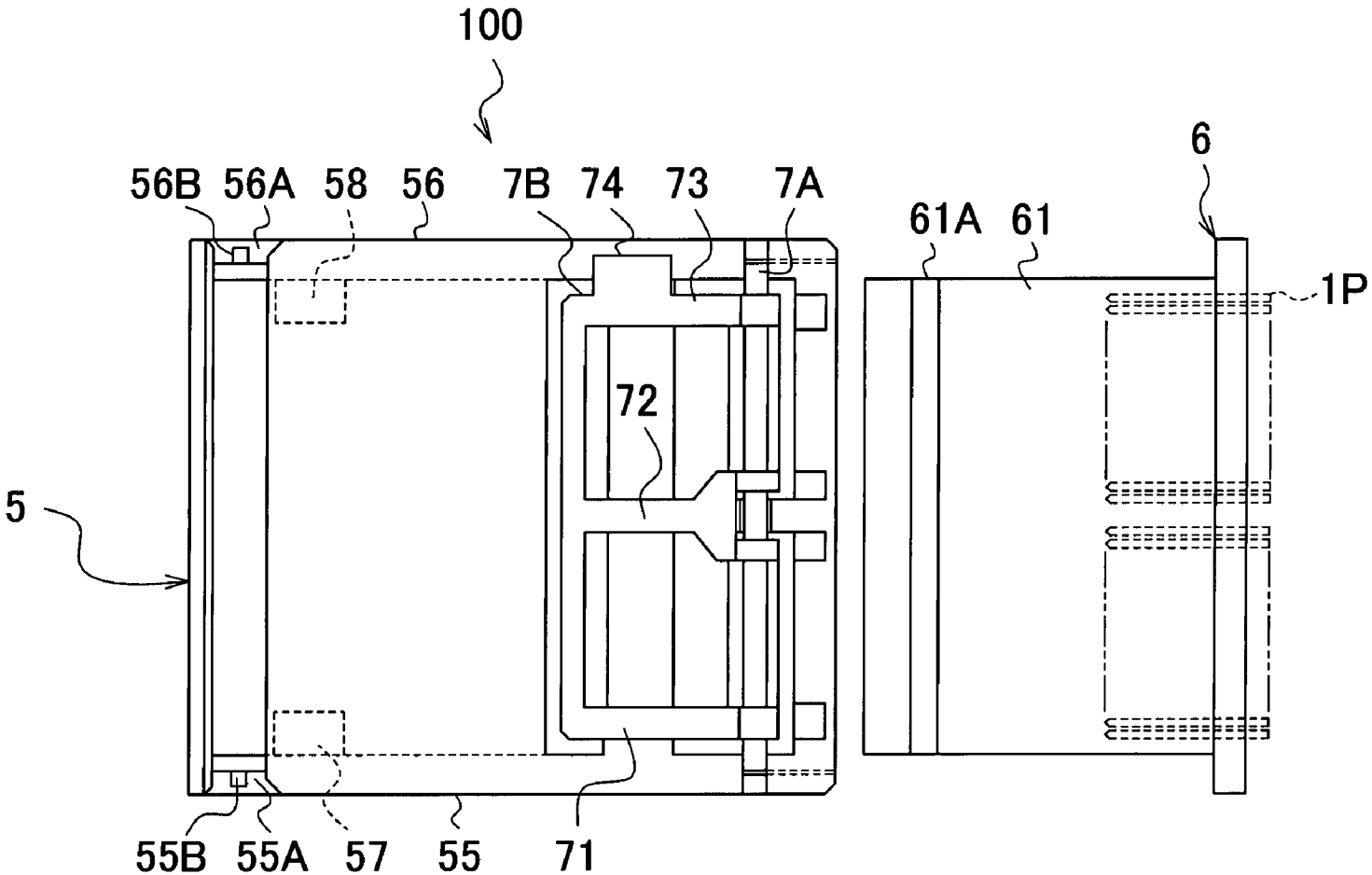
FIG. 6 is a plan view of the high-speed transmission connector according to the present invention.

FIG. 6 is a plan view of the connector 100 according to the present invention, and the configuration thereof will be described further with the aid of FIG. 6. As shown in FIG. 6, stepped grooves 55A and 56A are formed on the other end of the plug housing 5, so as to face away from each other. Detents 55B and 56B protrude from the side walls of the respective stepped grooves 55A and 56A.

The indents 81A and 82A formed in the flanges 81 and 82 shown in FIG. 4 and FIG. 5 are fit to the detents 55B and 56B, respectively, whereby the pressure-contact block 8 is assembled to the other end of the plug housing 5.

Next, the operations of the present invention will be described with reference to FIG. 7 through FIG. 9.

Figure 7:
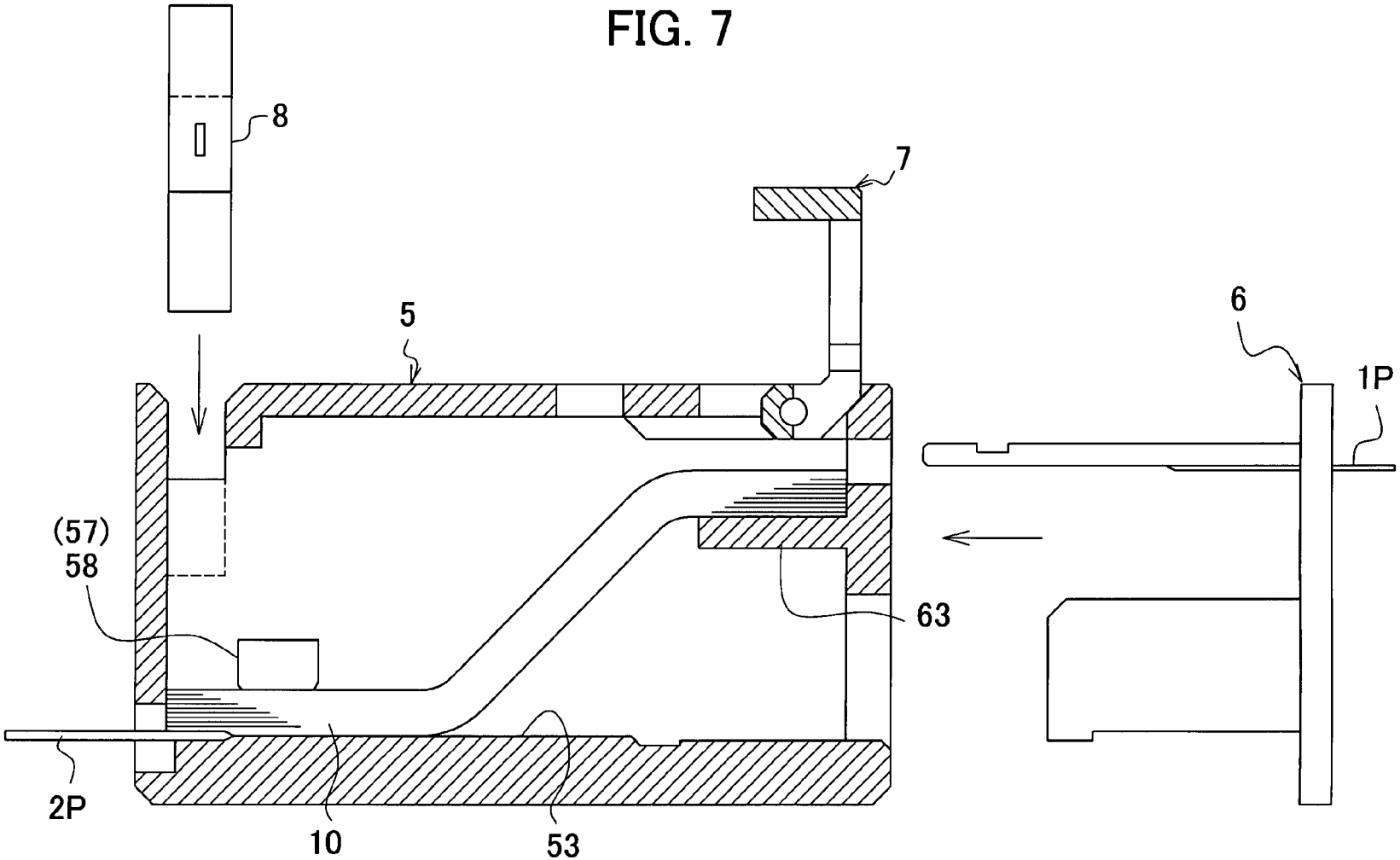
FIG. 7 is a longitudinal cross-section view of the plug housing according to the present invention, of a state before the receptacle header is inserted into the plug housing.

FIG. 7 is a longitudinal cross-section view of the plug housing 5, in the state before the receptacle header 6 is inserted into the plug housing 5. With the embodiment shown in FIG. 7, one end of the high-speed transmission connecting sheet 10 is held on the loading ledge 63.

On the other hand, cable retainers 57 and 58 (see FIG. 6) protrude within the plug housing 5 so as to oppose one another, so that the other end of the high-speed transmission connecting sheet 10 is held by the cable retainers 57 and 58 and an inner wall base face 53. Note that the plug pins 2P are nipped between the high-speed transmission connecting sheet 10 and the inner wall base face 53.

Figure 8:
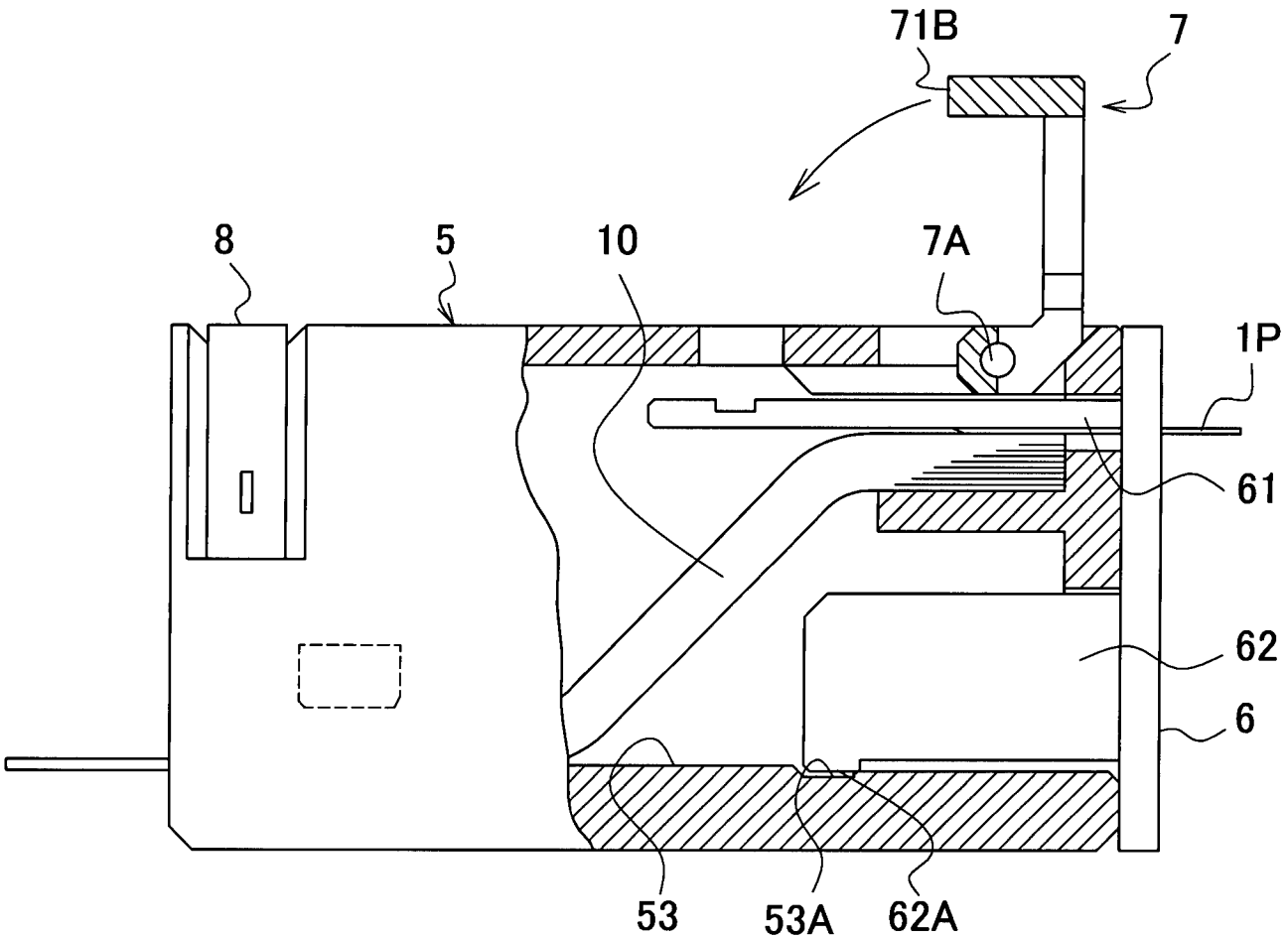
FIG. 8 is a side view of the plug housing according to the present invention, in a state in which the receptacle header is inserted into the plug housing.

In FIG. 7, the paddle 7 is in an opened state, and inserting the pressure-contact block 8 and the receptacle header 6 into the plug housing 5 in this state creates the state shown in FIG. 8.

FIG. 8 is a side view of the plug housing 5, and also is a longitudinal cross-section view of principal components of the plug housing 5. FIG. 8 shows the state in which the receptacle header 6 has been inserted into the plug housing 5, with the pressure-contact block 8 assembled into the plug housing 5.

In the state shown in FIG. 8, the tip portions of the receptacle pins 1P are positioned above the first elastomer connector 1E (see FIG. 1) of the high-speed transmission connecting sheet 10. Also, a fitting edge 62A of the fitting block 62 is positioned above a recess 53A formed in the inner wall base face 53.

The portion around the rotational shaft 7A is formed as a plate cam. Upon turning the paddle 7 in the counterclockwise direction from the state shown in FIG. 8, the plate cam having a certain profile presses down the horizontal piece 61 such that it moves downward. In this stage, the connector enters the state shown in FIG. 9.

Figure 9:
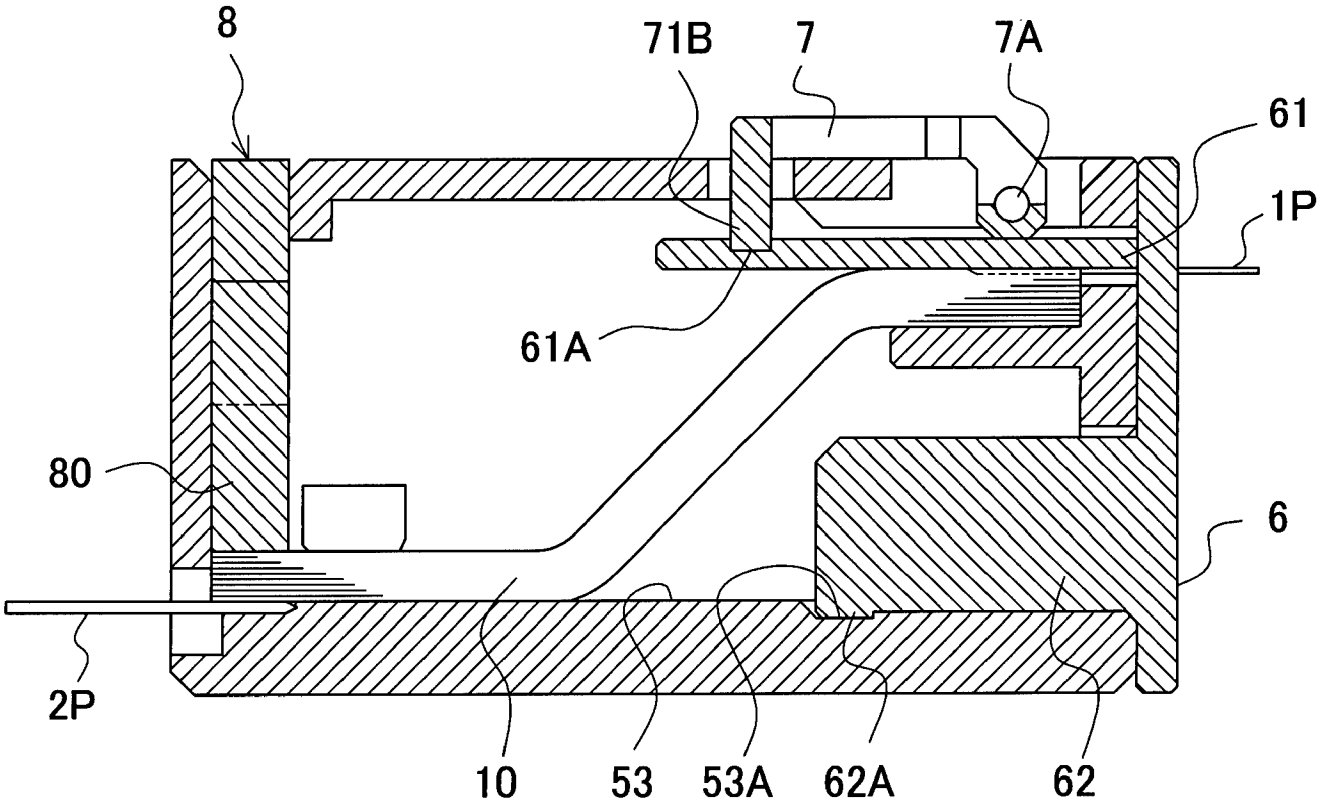
FIG. 9 is a longitudinal cross-section view of the plug housing according to the present invention, in a state in which the portion around the rotational shaft is pressing the horizontal piece against one end of the high-speed transmission connecting sheet.

FIG. 9 is a longitudinal cross-section view of the plug housing 5, in a state in which the portion around the rotational shaft 7A is pressing the horizontal piece 61 against one end of the high-speed transmission connecting sheet 10 with the principle of "leverage". In the state shown in FIG. 9, the tip portions of the receptacle pins 1P are pressed against so as to be embedded in the third elastomer strips 1B (see FIG. 1).

Also, as shown in FIG. 9, in the state in which the paddle 7 is closed, the claw 71B of the paddle 7 is retained in the groove 61A of the horizontal piece 61. The claw 71B and the groove 61A form a locking mechanism so that the receptacle header 6 does not come loose from the plug housing 5.

Furthermore, the fitting edge 62A of the fitting block 62 is fit to the recess 53A formed in the inner wall base face 53, so the receptacle header 6, as well as the receptacle pins 1P will not come loose from the plug housing 5 easily. Thus, the present invention ensures the connection between the receptacle pins 1P, which are external connecting terminals on one side, and the high-speed transmission connecting sheet 10.

The receptacle header 6 can be removed from the plug housing 5 by turning the paddle 7 in the clockwise direction.

Also, as can be understood best from FIG. 9, the tips of the plug pins 2P are nipped between the other end of the high-speed transmission connecting sheet 10 and the inner wall base face 53. The upper face of the other end of the high-speed transmission connecting sheet 10 is pressed by the bottom face of the protruding piece 80 of the pressure-contact block 8. In the state shown in FIG. 9, the tips of the plug pins 2P are pressed against so as to be embedded in the second elastomer strips 1B (see FIG. 2).

In FIG. 9, both ends of the high-speed transmission connecting sheet 10 are installed within the plug housing 5 in a stepped manner. Such a stepped arrangement is impossible with rigid multi-layer printed boards. With the present invention, the high-speed transmission connecting sheet 10 is a multi-layer sheet having a structure in which elastomer sheets are layered. This enables the flexible layout of a connection member for connecting transmission Also, in FIG. 9, the other ends of the receptacle pins 1P may be attached to a daughter board, for example, and the other ends of the plug pins 2P may be attached to a mother board (or a backplane), for example.

The invention claimed is:

1. A high-speed transmission connector for electrically connecting, through high-speed transmission paths, a plurality of first external connecting terminals disposed on one end and a plurality of second external connecting terminals disposed on another end, said connector comprising:

a high-speed transmission connecting sheet wherein a top sheet on which first elastomer connectors are formed on one end, a bottom sheet on which second elastomer connectors are formed on the other end, and a high-speed transmission path board for three-dimensionally connecting said first elastomer connectors and said second elastomer connectors through a plurality of high-speed transmission paths having a stripline structure, are layered; and an insulating plug housing in which said high-speed transmission connecting sheet is installed, with said first elastomer connectors being disposed on one inner wall of opposing inner walls and said second elastomer connectors being disposed on the other inner wall of said opposing inner walls;

wherein said plurality of first external connecting terminals disposed on said one end are disposed on said first elastomer connectors, said plurality of second external connecting terminals disposed on said other end are disposed under said second elastomer connectors, and both ends of said top sheet of said high-speed transmission connecting sheet are pressed into contact such that said first external connecting terminals and said second external connecting terminals are connected through said plurality of high-speed transmission paths.

2. A high-speed transmission connector according to claim 1, with the high-speed transmission connecting sheet installed within, the high-speed transmission connecting sheet comprising:

a top sheet wherein a plurality of first elastomer strips having electroconductivity between the front and rear sides are disposed on one end of a first elastomer sheet which is non-electroconductive, so as to form first elastomer connectors at said one end;

a bottom sheet wherein a plurality of second elastomer strips having electroconductivity between the front and rear sides are disposed on the other end of a second elastomer sheet which is non-electroconductive, so as to form second elastomer connectors at said other end;

a plurality of high-speed transmission path boards in which a plurality of third elastomer strips which are electroconductive between the front and rear sides are disposed on both ends of a third elastomer sheet having a certain dielectric constant, so as to form third elastomer connectors at the both ends, and which has a stripline structure in which a plurality of high-speed transmission paths are formed as patterns on said third elastomer sheet for connecting said plurality of third elastomer strips formed on both ends of said third elastomer sheet; and one or more intermediate layer boards wherein a plurality of fourth elastomer strips which are electroconductive between the front and rear sides are disposed on both ends of a fourth elastomer sheet which is non-electroconductive, so as to form fourth elastomer connectors at said both ends;

wherein said intermediate layer boards are interposed between said high-speed transmission path boards, said plurality of high-speed transmission path boards and said one or more intermediate layer boards are layered such that the plurality of high-speed transmission paths are three-dimensionally connected, and furthermore, said top sheet and said bottom sheet are layered on the front and the back thereof.

3. A high-speed transmission connector according to claim 2, with the high-speed transmission connecting sheet installed therewithin, wherein the plurality of parallel high-speed transmission paths formed on one of said high-speed transmission path boards disposed upper side and the plurality of parallel high-speed transmission paths formed on another of said high-speed transmission path boards disposed lower side are arrayed alternately.

4. A high-speed transmission connector according to claim 1, wherein said high-speed transmission paths include differential signal paths forming pairs.

5. A high-speed transmission connector according to claim 1, further comprising:

an insulating receptacle header which has a horizontal piece inserted from one end side of said plug housing, and which is disposed such that said plurality of first external connecting terminals come into contact with the lower wall of said horizontal piece; and a paddle which is rotatably disposed at the top of one end of said plug housing and of which around the center of rotation is formed as a plate cam;

wherein, in a state of said horizontal piece of said receptacle header being inserted into said plug housing, upon turning said paddle, said plate cam presses down said horizontal piece so that said plurality of first external connecting terminals are pressed into contact with said first elastomer connectors.

6. A high-speed transmission connector according to claim 1, further comprising an insulating pressure-contact block assembled to the other end of said plug housing, wherein said pressure-contact block presses said top sheet so as to press said second elastomer connectors into contact with said plurality of second external connecting terminals.

7. A high-speed transmission connector according to claim 5, wherein a groove is formed on the upper face of said horizontal piece, and an L-shaped claw is formed on the edge portion of said paddle, thereby configuring a locking mechanism for retaining said claw at said groove in said horizontal piece upon turning said paddle to a laid down state.

8. A high-speed transmission connector according to claim 2, wherein said high-speed transmission paths include differential signal paths forming pairs.

9. A high-speed transmission connector according to claim 3, wherein said high-speed transmission paths include differential signal paths forming pairs.

* * * * *

UNITED STATES PATENT AND TRADEMARK OFFICE

CERTIFICATE OF CORRECTION

PATENT NO. : 7,175,457 B2
APPLICATION NO. : 10/572562
DATED : February 13, 2007
INVENTOR(S) : Shuichi Inoue It is certified that error appears in the above-identified patent and that said Letters Patent is hereby corrected as shown below:

Title Page:

Item (54) should be read as follows:

-- HIGH-SPEED TRANSMISSION CONNECTOR --.

Signed and Sealed this

Fifteenth Day of May, 2007

JON W. DUDAS

*Director of the United States Patent and Trademark Office*